US007700900B2

(12) United States Patent
Geiger et al.

(10) Patent No.: US 7,700,900 B2
(45) Date of Patent: Apr. 20, 2010

(54) PANEL ARRANGEMENT FOR A DOMESTIC APPLIANCE

(76) Inventors: Peter Geiger, Auf der Bag 16, 72800 Eningen u.A. (DE); Ronald Hegewald, Untere Hammerwiese 12, 93164 Laaber (DE); Michael Seikel, Cheruskerstrasse 34b, 10829 Berlin (DE)

( * ) Notice: Subject to any disclaimer, the term of this patent is extended or adjusted under 35 U.S.C. 154(b) by 0 days.

(21) Appl. No.: 11/384,028

(22) Filed: Mar. 16, 2006

(65) Prior Publication Data

US 2006/0219697 A1 Oct. 5, 2006

Related U.S. Application Data

(63) Continuation of application No. PCT/EP2004/010288, filed on Sep. 15, 2004.

(30) Foreign Application Priority Data

Sep. 17, 2003 (DE) ..... 103 44 918

(51) Int. Cl.
*H05B 1/02* (2006.01)
*D06F 39/00* (2006.01)

(52) U.S. Cl. ..... 219/506; 219/445.1; 219/452.11; 68/12.27; 68/3 R

(58) Field of Classification Search ..... 219/445.1, 219/452.11, 506; 68/12.27, 3 R
See application file for complete search history.

(56) References Cited

U.S. PATENT DOCUMENTS

| | | | | |
|---|---|---|---|---|
| 5,243,453 | A * | 9/1993 | Kawaguchi et al. | 349/60 |
| 5,524,362 | A * | 6/1996 | Quandt et al. | 34/526 |
| 6,343,492 | B1 * | 2/2002 | Seagar et al. | 68/142 |
| 6,865,911 | B2 * | 3/2005 | Bolduan et al. | 68/17 R |

FOREIGN PATENT DOCUMENTS

| | | | |
|---|---|---|---|
| DE | 34 04 256 | A | 8/1985 |
| DE | 91 06 601 | U1 | 8/1991 |
| DE | 41 39 588 | A | 6/1992 |
| DE | 1982334 | | 3/1998 |
| DE | 196 51 821 | A | 6/1998 |
| DE | 102 00 317 | A | 7/2003 |
| JP | 01236095 | A * | 9/1989 |
| JP | 02243195 | A * | 9/1990 |
| WO | WO 02/052091 | A1 * | 7/2002 |

OTHER PUBLICATIONS

International Preliminary Report of Patentability dated Aug. 31, 2006.

* cited by examiner

*Primary Examiner*—Stephen J Ralis
(74) *Attorney, Agent, or Firm*—Knobbe Martens Olson & Bear LLP

(57) ABSTRACT

A panel arrangement for a domestic appliance, having a panel which can be fitted to the domestic appliance such that it is visible from the outside. Indicator and/or operator controls are provided which are mounted on the panel. A printed circuit board comprises control and possibly power electronics and can be arranged in the interior of the domestic appliance. The indicator and/or operator controls are connected to the printed circuit board. At least some of the indicator and/or operator controls are mounted on the panel substantially independently of the layout of the printed circuit board and are connected to the printed circuit board via at least one flexible supply line.

9 Claims, 3 Drawing Sheets

PANEL ARRANGEMENT FOR A DOMESTIC APPLIANCE

CROSS-REFERENCE TO RELATED APPLICATIONS

This application is a continuation of PCT/EP2004/010288 filed Sep. 15, 2004.

BACKGROUND OF THE INVENTION

The present invention relates to a panel arrangement for a domestic appliance, having a panel which can be fitted to the domestic appliance such that it is visible from the outside, at least one of indicators and operator controls which are mounted on the panel, and having a printed circuit board which comprises control and possibly power electronics and can be arranged in the interior of the domestic appliance, with the at least one of indicators and operator controls being connected to the printed circuit board.

A panel arrangement is known, by way of example, in domestic appliances in the form of washing machines and tumble dryers, for example from DE 196 51 821 A1 or DE 198 12 334 A1.

In this type of domestic appliance, a distinction is generally made between top loaders and front loaders. Front loaders are sold both as stand-alone devices and integrated devices. The front face of front loaders has an opening for the purpose of loading a drum. A panel arrangement of the type in question is also provided above the loading opening on the front face of domestic appliances of this type. The indicator and/or operator control means for setting appliance functions such as program selection, temperature, spin speed etc. are provided on the panel arrangement. Furthermore, the panel arrangement generally has indicator elements which may comprise simple monitoring lamps or may be in the form of digital indicators or the like.

A functional container is also generally integrated in the panel arrangement, at least in the case of washing machines and tumble dryers. In washing machines, the functional container serves to fill laundry detergent, fabric softener etc. and generally takes the form of a drawer. In condenser tumble dryers, the functional container takes the form of a container for collecting the condensation water produced during the tumble drying process.

In this case, the functional container generally has a front which matches the design of the panel on which the indicator and operator control means are provided.

For some years there has been a trend toward standardizing the technology of domestic appliances. Depending on the make and model, these appliances differ essentially only in appearance, particularly in the number of indicator and operator control means and in the scope of functions improved by these means, respectively.

However, the interiors of these domestic appliances are largely standard. Therefore, domestic appliances of different makes and trademarks, respectively, may contain the same printed circuit board, for example. Only the shape of the switches is different.

In this case, the panel used in the panel arrangement generally extends over the entire width of the appliance. The panel has an integrally formed frame section in the region in which the functional container is inserted. In this case, the panel is generally produced from a high-quality plastic (for example ABS) in an injection molding process. The printed circuit board, which, in addition to the control electronics, is generally fitted with all the power electronics for operating the domestic appliances, is fixed to the rear face of the panel, in general by latching connections (plastic clip connections).

The aim here is to produce just one injection mold for all models of one make. The varying number of indicator and operator control elements is accommodated by providing openings after the panels are produced. However, in order to implement the large number of different combinations of indicator and operator control means by means of a single panel, the rear face is generally provided with a large number of protrusions and armatures to which these combinations of indicator and operator control means can be fixed, depending on the model.

The layout of the printed circuit board having the control and power electronics is such that the indicator and operator control means are provided directly on said printed circuit board. In other words, the relative position of the various indicator and operator control means is specified by the layout of the printed circuit board.

If the indicator and operator control means are to be changed over to other types, the printed circuit board has to be completely rerouted. Furthermore, experience has shown that changes are made and other modifications (for example in the form of further models) are needed even after production has started, despite careful planning, on account of marketing requirements. This considerably increases the complexity of the printed circuit board and naturally also the complexity of the injection mold for the panel. In many cases, additional molds have to be created.

Since the panel extends over the entire width of the domestic appliance and also has to be designed to be relatively rigid in the region of the frame section which surrounds the functional container, a comparatively large amount of expensive plastic material is required for the panel.

SUMMARY OF THE INVENTION

Against the above background, the object of the present invention is to provide an improved panel arrangement for a domestic appliance.

In the case of the panel arrangement mentioned in the introduction, this object is achieved in that at least some of the at least one of indicators and operator controls are mounted on the panel substantially independently of the layout of the printed circuit board and are connected to the printed circuit board via at least one flexible supply line.

The above object is also achieved by a domestic appliance having a panel arrangement according to the invention.

In the following, the term indicators and/or operator controls shall refer to at least one of indicators and operator controls.

Considerably greater flexibility when designing the operator control surface can be achieved by the inventive measures. Since the indicator and/or operator controls can be mounted independently of the layout of the printed circuit board, it is also possible to change the operator control surface of a current series. The layout of the printed circuit board may remain unchanged here.

Since the indicators and/or operator controls are not provided directly on the printed circuit board, they can be arranged over the area of the panel in almost any desired manner. The printed circuit board can therefore be uniform for different models of one make and even for different makes, even when there are a high number of variants. This means costs can be lowered in spite of the indicator and/or operator controls being individually mounted on the panel.

Greater design freedom also creates additional buyer potential. Shorter development times can be realized in the case of variants and product improvements.

The indicators and/or operator controls and the printed circuit board may be individually connected via single flexible supply lines. As an alternative, it is also possible to produce a cable harness which combines the different indicator and operator control means with one another. The cable harness can be directly connected to the printed circuit board. However, it is also generally feasible to provide one of the indicators and/or operator controls as a "coupling means" between the printed circuit board and the various indicators and/or operator controls, and possibly to fix it rigidly to the printed circuit board.

It is preferred if not all, but a majority, of the indicators and/or operator controls can be mounted on the panel substantially independently of the layout of the printed circuit board.

The object can thus be fully achieved.

Particular preference is given to a situation in which at least some of the indicators and/or operator controls are in each case individually connected to the printed circuit board.

This can provide a high degree of flexibility, even during final assembly.

According to one further embodiment, the flexible supply lines of the individually connected indicators and/or operator controls are combined to form a cable harness.

A cable harness of this type can be prefabricated, so that final assembly can be achieved in a cost-effective manner in spite of the flexible user surface.

According to a further alternative embodiment, at least some of the indicators and/or operator controls are provided with a bus interface and are connected to the printed circuit board via a bus.

As a result, outlay on wiring can be reduced overall. However, the complexity of each indicators and/or operator controls may increase on account of the bus interfaces which are required.

According to one embodiment which is preferred overall and illustrates its own invention independently of how the indicators and/or operator controls are mounted and connected, the printed circuit board is mounted on a support which is provided separately from the panel and can be arranged in the interior of the domestic appliance.

This enables the domestic appliances to be standardized further since the printed circuit boards which are provided uniformly for various models/makes are no longer mounted on the rear face of the panel but on a support which is provided separately from the panel. The complexity of the mold for producing the panel can also be considerably reduced as a result of this.

In this case, particular preference is given to a situation in which the printed circuit board is mounted on the support in such a way that it is situated opposite the rear face of the panel.

Short wiring paths are the result.

It is also advantageous when the support extends over the entire width of the domestic appliance.

In this case, it is possible to use the support for further functions, for example for stabilizing the housing of the domestic appliance.

Particular preference is given to a situation in which the support has a retaining section for mounting the printed circuit board and a container holding section for holding a functional container which is relevant for the function of the domestic appliance.

In this embodiment, in addition to mounting the printed circuit board, the support assumes the function of mounting the functional container (for example a laundry detergent container or a condensation water container).

The number of parts of the standardized domestic appliance can therefore be reduced further.

In this case, particular preference is given to a situation in which the support, which has the retaining section and the container holding section, is integrally formed.

This can result in simple production of the support and a further reduction in the number of parts.

According to a further preferred embodiment, a cover is provided on the container holding section and has a fluid connection for supplying fluid to the functional container.

In a washing machine, the cover can therefore be designed to flush in water, for example. In a tumble dryer, the cover may be designed to pass condensation water to the functional container.

Since the cover requires a relatively complex structure, in particular with the function of flushing in water, on account of different programs, it may be expedient to form this cover separately from the support.

According to one further preferred embodiment, the container holding section of the support has a frame section through which the functional container can be pushed from the outside and which is visible on the domestic appliance from the outside when the functional container is removed.

As a result of this, in contrast to the prior art, the support assumes the task of guiding the functional container into the container holding section. Therefore, a frame section which is used for this purpose is no longer required on the panel itself.

This has advantages in terms of cost since the support can be produced from a more cost-effective material than the panel.

The impression of quality is not impaired by this since the frame section is in any case generally covered by the front of the functional container which has a surface which is similar or of the same quality as the panel.

Particular preference is therefore given to a situation in which the panel is arranged laterally adjacent to the frame section.

In this embodiment, the panel can be formed without a frame section. This results firstly in a lower outlay on materials. Furthermore, the panel can be formed with a thinner material thickness overall on account of the lower strength requirements and the lower total area.

In contrast to panels from the prior art, the panel according to this embodiment no longer extends over the entire width of the domestic appliance.

According to an embodiment which is further preferred overall, the panel is fixed to the support.

As a result, the support is provided with a further function. The panel can also be fixed to the support in a comparatively simple manner, for example by a latching connection.

However, particular preference is given to a situation in which the panel is fixed to the support by means of a securing element which is fitted to the side of the panel in the region of the frame section of the support.

The securing element therefore cannot be seen when the domestic appliance is viewed from the front. The securing element for removing the panel can be accessed only when the functional container is removed.

According to a further embodiment which is preferred overall, the support has, in the region in which the printed circuit board is mounted, an aperture for a cable harness to pass through.

According to a further embodiment which is preferred overall, a controller, in particular a water level controller, of the domestic appliance is fixed to the support.

The overall effect is that the support can be the "central" fitting element for a majority or all of the important functional components of the domestic appliance, apart from those which cannot be positioned in the upper region of the domestic appliance on account of their function (for example the pump, the drive motor etc.).

According to a further preferred embodiment, the support is produced from plastic, in particular as an integral component.

The support is preferably produced in an injection molding process, namely from a comparatively cost-effective, stable plastic (for example PP). Since the support is arranged in the interior of the domestic appliance, the condition of its surface is of rather secondary importance.

According to a further preferred embodiment, the panel is formed in the manner of a box with a front and a circumferential rim section.

This shaping, which is simple in comparison to the prior art, allows the panel to be formed in a cost-effective manner and with a low material thickness. The openings for mounting the various indicators and/or operator controls can be made after the shaping, for example by punching, by water-jet cutting or the like.

In the domestic appliance according to the invention, it is particularly advantageous when the support is secured to a section of a front wall of the domestic appliance.

As a result, the support can firstly be fixed in a simple manner. Secondly, said support can make a particular contribution to increasing the strength and rigidity of the housing of the domestic appliance in this embodiment.

In this case, it is particularly advantageous when the support is suspended on the front wall section by means of hooks.

In this way, complicated screw connections can be dispensed with. Assembly is simplified.

It goes without saying that the abovementioned features and those still to be explained below can be used not only in the respectively specified combination but also in other combinations or alone, without departing from the scope of the present invention.

BRIEF DESCRIPTION OF THE DRAWINGS

Exemplary embodiments of the invention are explained in greater detail in the following description and are illustrated in the drawing, in which.

DETAILED DESCRIPTION OF THE PREFERRED EMBODIMENT

Figure 1:
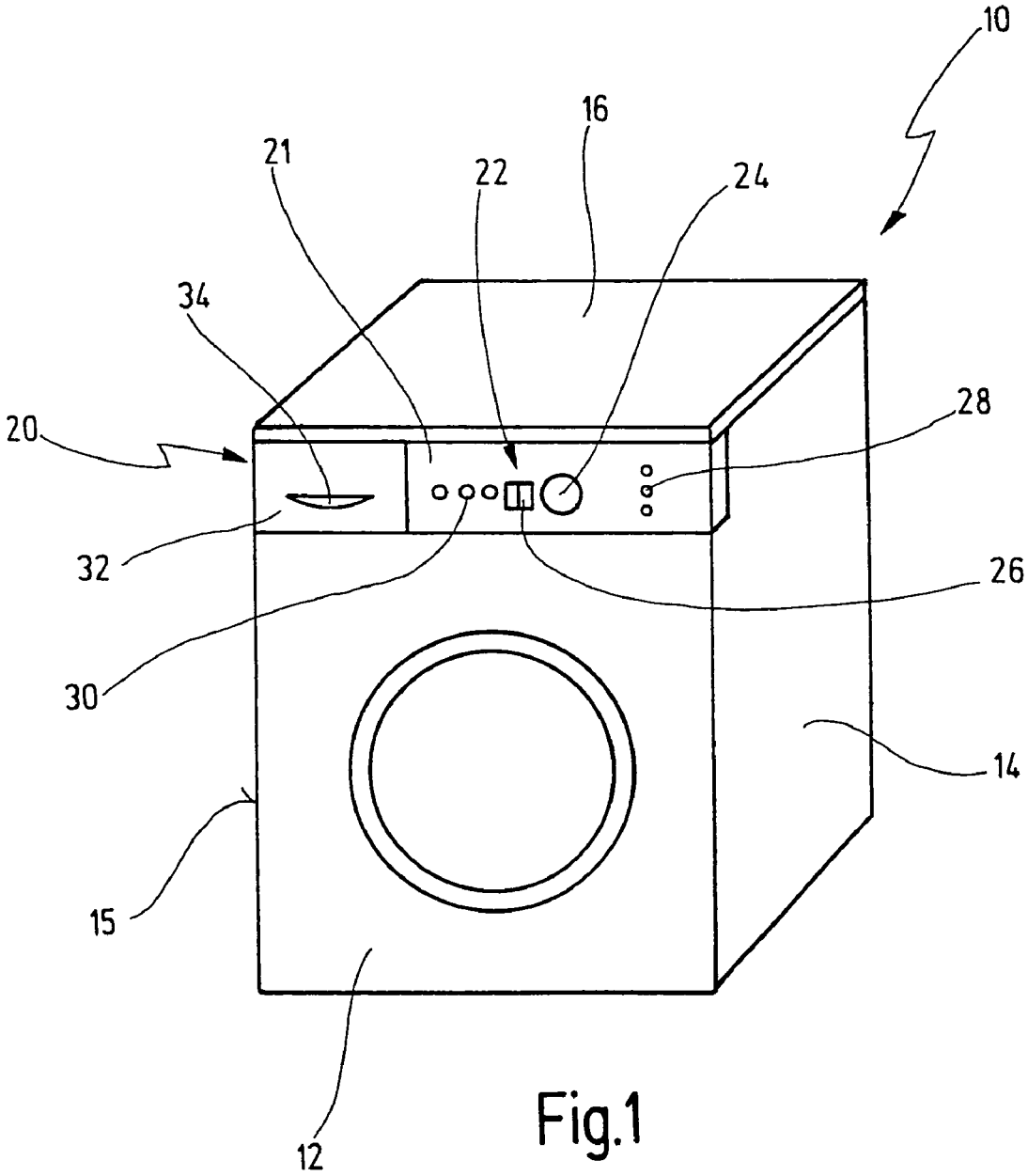
FIG. 1 shows a perspective/schematic view of a domestic appliance according to the invention.

In FIG. 1, a domestic appliance according to the invention is denoted 10 in general.

The domestic appliance 10 is in the form of a front-loading washing machine. The domestic appliance 10 has a front wall 12 and two side walls 14, 15 and a cover 16. When the cover 16 is removed, the domestic appliance 10 can also be used as an integrated appliance.

A panel arrangement 20 according to the invention is provided on the front face of the domestic appliance 10 above the front wall. The panel arrangement 20 extends over the entire width of the domestic appliance 10 and is arranged between the cover 16 and the front wall 12. The panel arrangement 20 has a panel 21 which is arranged adjacent to the side wall 14. A plurality of indicators and operator controls 22 are mounted on the panel 21. The indicators and operator controls 22 comprise a rotary program knob 24, two rotation-speed selection buttons 26, option buttons 28 and a plurality of indicator LEDs 30.

The panel arrangement 20 also comprises a functional container 32 in the form of a drawer for laundry detergent. The functional container 32 is arranged between the opposite side wall 15 and the panel 21 and can be pushed into the domestic appliance 10 and pulled out of it by means of a handle 34.

In the domestic appliance 10 according to the invention, the panel 21 extends only between the side wall 14 and the functional container 32. The indicators and operator controls 22 which are mounted on said panel can be fixed independently of the layout of a printed circuit board which is mounted in the interior of the domestic appliance 10.

Figure 2:
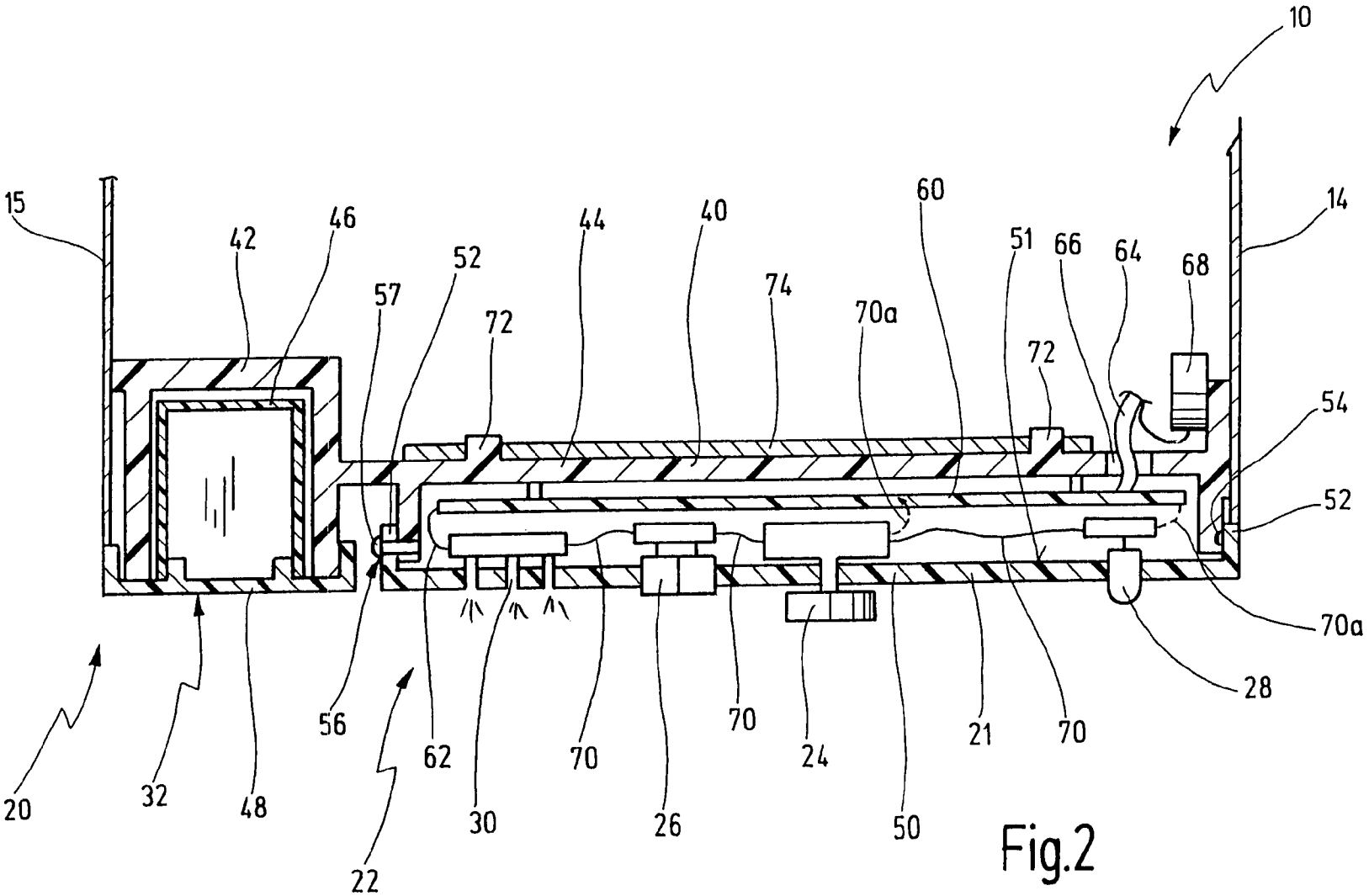
FIG. 2 shows a cross-sectional view through the region of the panel arrangement of a domestic appliance according to the invention.

FIG. 2 is a schematic cross-sectional view through a section of the domestic appliance 10 according to the invention in the region of the panel arrangement 20.

A support 40 is mounted inside the domestic appliance 10 directly behind the panel 21. The support 40 extends between the two side walls 14, 15 and has a retaining section 44 and a container holding section 42.

The retaining section 44 is arranged directly behind the panel 21 and oriented approximately parallel to it.

The container holding section 42 is arranged adjacent to the side wall 15 and is designed to hold a container body 46 of a functional container 32. A container front 48, which can be latched to the container body 46 for example, is provided on the front face of the functional container 32.

The container front 48 is generally formed from the same material as the panel 21 and together with said panel forms a continuous operator control surface.

The panel 21 has a panel front 50 which is aligned with the container front 48 and whose rear face 51 is directed toward the interior of the domestic appliance 10. A largely circumferential rim section 52 extends rearward from the panel front 50, so that the panel 21 has a simple, approximately box-like or tray-like form overall.

The panel 21 is fixed to the support 40 by means of the rim section 52. The fixing is carried out by a latching connection 54 adjacent to the side wall 14. As an alternative, the rim section 52 engages behind the support 40 in this region, without having to achieve a latching function.

On the opposite side, adjacent to the functional container 32, the panel 21 is fixed to the support 40 by means of a screw connection 56. The screw connection 56 comprises a screw 57 which passes through the rim section 52 and the support 40 from the side. Therefore, the screw connection 56 is not visible from the outside when the functional container 32 is pushed into the container holding section 42.

Furthermore, a printed circuit board 60, which comprises the control electronics and preferably also the power electronics of the domestic appliance 10, is fixed to the support 40.

The printed circuit board 60 is fixed to the support 40 in such a way that it is situated opposite the rear face 51 of the panel 21.

The indicators and operator controls 22 each have elements which are accessible from the front face of the panel 21. Furthermore, the indicators and operator controls each have base bodies which are situated behind the panel 21. These base bodies may comprise, for example, basic functions of the respective indicators and operator controls (such as potentiometer, LEDs etc.). However, it goes without saying that the base bodies preferably only comprise the basic functions required for the respective indicators and operator controls 22. In contrast, the actual intelligence which actuates the respective indicator and operator controls 22 is located in the control electronics of the printed circuit board 60.

The indicator and operator controls 22 are therefore connected to the printed circuit board 60.

In order to make the illustration clearer, the indicators and operator controls 22 in FIG. 2 are connected to the printed circuit board 60 only via a flexible line 62. However, this is generally a cable harness which branches off to the individual indicators and operator controls 22. In FIG. 2, this is likewise only illustrated in a simplified fashion by connecting lines 70 between the individual indicators and operator controls 22.

As an alternative, it is also possible to connect individual indicators and operator controls 22 directly to the printed circuit board 60, as shown in dashed lines by 70*a*.

The concept of providing the indicators and operator controls 22 separately from the printed circuit board 60 means it is possible to arrange and distribute the indicators and operator controls on the base area of the panel 21 in almost any desired manner. This means a greater degree of freedom in terms of the design of the operator control surface.

This also means it is possible to produce a greater variety of operator control surfaces even though the underlying control and power electronics (and also other parts) of the domestic appliance 10 may be identical for various models and even various makes.

It goes without saying that the individual indicators and operator controls 22 can also be connected to the circuit board 60 by means of a bus connection, for example.

An aperture 66 through which a cable harness 64 is passed is provided in the support 40. The cable harness 64 starts from the printed circuit board 60 and branches off to the various components of the domestic appliance, for example the pump, drum drive motor, sensors etc.

A water level controller 68 is also fixed to the support 40, to be more precise to a rear face of the support 40. This water level controller is likewise connected to the cable harness 64. Further control and functional elements can also be fixed to the support 40, for example drum lighting or a holding means with a door closure.

Since the indicators and operator controls 22 can be arranged in a variable manner, the printed circuit board 60 can be formed in a substantially identical manner for the various types of washing machines. The scope of functions which differs from type to type can be implemented, for example, by switching means on the printed circuit board 60 (e.g. DIP switches) or by software solutions in microcontrollers which are provided on the printed circuit board 60.

FIG. 2 also illustrates how the support 40 can be secured to the housing of the domestic appliance 10 in a simple manner. FIG. 2 illustrates a section 74 of the front wall 12 in section. The front wall section 74 is set back in a planar fashion in relation to the front wall shown in FIG. 1; this can be done in a simple manner by bending the front wall plate.

However, the front wall section 74 extends approximately parallel to the front wall 12. Two or more hooks 72 are integrally formed on the rear face of the support 40. The hooks 72 are suspended in openings which are not specifically identified or on an upper edge of the front wall section 74. The support 40 can therefore be secured to the housing of the domestic appliance 10 without the need for complicated screw connections. Assembly is considerably simplified.

Figures 3, 4:
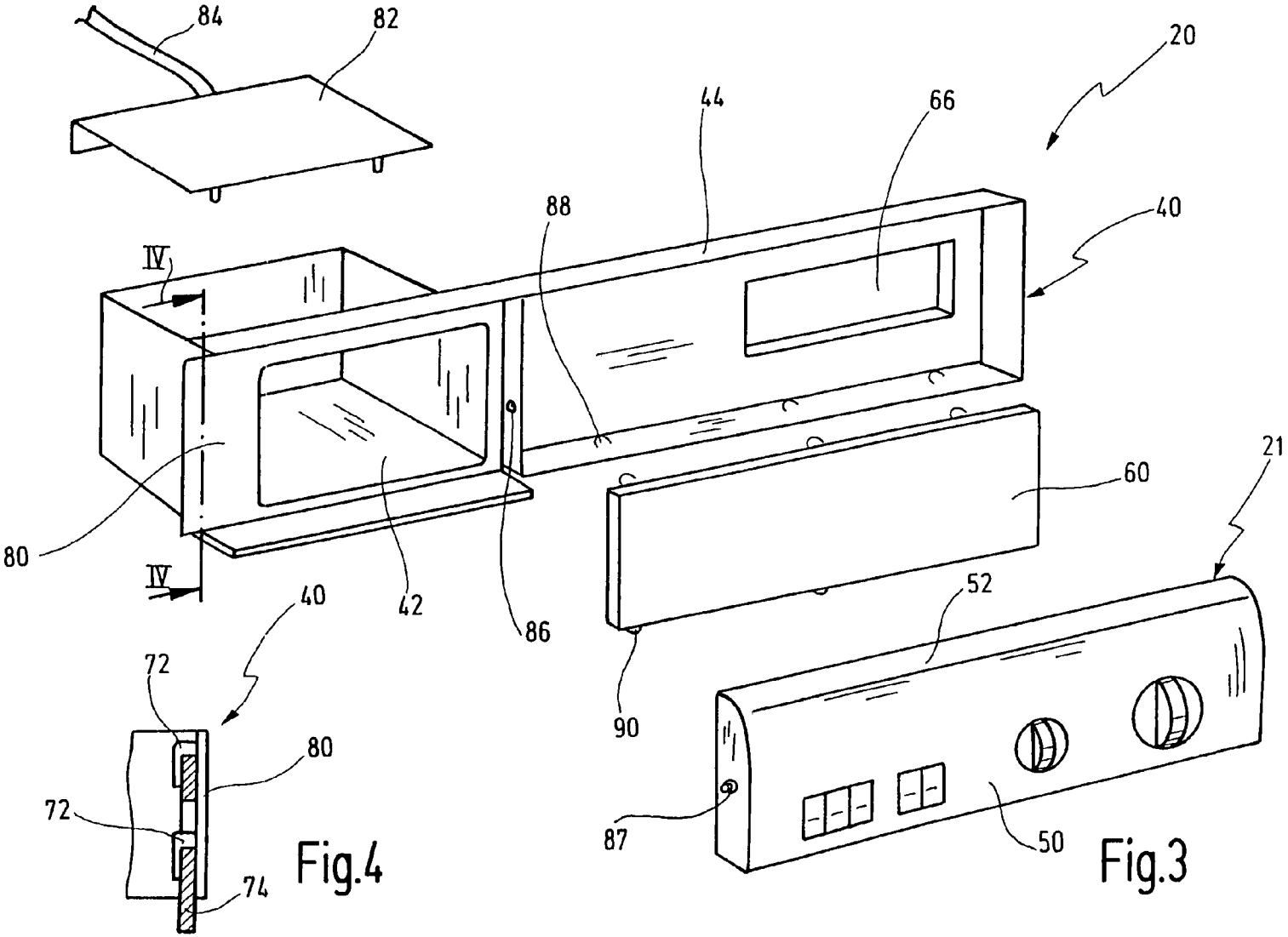
FIG. 3 shows a perspective/schematic exploded illustration of a panel arrangement according to the invention.
FIG. 4 shows a sectional view along line IV-V from FIG. 3.

FIG. 3 is an exploded view of a further embodiment of a panel arrangement 20 according to the invention.

The general structure and general functionality of the panel arrangement 20 which is illustrated in FIG. 3 correspond to those of the panel arrangement 20 for FIG. 2. Identical elements are therefore identified by the same reference numerals.

The text which follows deals only with differences or those aspects of the panel arrangement 20 which are not illustrated in FIG. 2.

Therefore, FIG. 3 shows that the front face of the container holding section 42 has a frame section 80 through which the functional container 32 (not illustrated in FIG. 3) can be inserted.

The frame section 80 can be seen on the appliance from the outside when the functional container 32 is removed. Therefore, the surface of the frame section 80 is preferably particularly smooth and said frame section may possibly be subsequently machined in order to create a better surface.

However, the support 40 is generally produced from a cost-effective plastic such as PP, preferably integrally in a plastic injection molding process or the like.

In contrast to this, the panel 21 (and the container front 48) are produced from a high-quality plastic such as ABS in order to create a high-quality operator control surface.

FIG. 3 also shows that the container holding section 42 is preferably open at the top.

A cover 82 which is produced separately from the support 40 is fitted on the container holding section 42.

The cover 82 may be in the form of a flushing unit and for this purpose be equipped with a fluid connection 84 for supplying water.

Since the laundry detergent (in the case of a washing machine) in the functional container 32 has to be flushed into the washing water by water, the cover 82 is designed to flush water into the functional container 32, which is open at the top, via the fluid connection 84. It goes without saying that a plurality of chambers of the functional container may have to be flushed here. However, this is known in principle from the prior art and is not described in any detail here.

If the domestic appliance 10 is a tumble dryer, condensation water can be supplied via the fluid connection 84, this water then being conducted to the closed functional container 32 in order to collect the condensation water.

FIG. 3 also shows that a strut, which projects forward, of the support 40 is equipped with a hole 86 for receiving the screw 57. A corresponding hole 87 is correspondingly provided on the rim section 52 of the panel 21.

The printed circuit board 60 is provided with a plurality of latching lugs 90 which engage in corresponding latching receptacles 88 in the support 40.

Therefore, both the printed circuit board 60 and the panel 21 can be mounted on the support 40 in a simple and thus low-cost manner. The cover 82 is also preferably clipped onto the container holding section 42 by means of latching lugs (not identified in detail). The support 40 can also be secured to the side walls 14, 15 (not illustrated) or can be fixed to another housing strut. The support 40 may furthermore assume the function of reinforcing the housing of the domestic appliance 10.

Furthermore, FIG. 4 is a schematic sectional view along a plane perpendicular to the front face of the support 40. It can be seen that two hooks 72 which are arranged one above the other are integrally formed on the rear face of the support 40 in the region of the frame section 80. Corresponding hooks 72 are provided on the opposite side adjacent to the side wall 14.

The front wall section 74 is likewise illustrated in FIG. 4. It can be seen that the support 40 is suspended in the front wall section 74. Complicated assembly with screws can therefore be dispensed with.

Overall, the domestic appliance according to the invention and the panel arrangement according to the invention provide an extremely high degree of flexibility when designing the operator control surface, even within the series.

A common platform in the form of the support and the printed circuit board can be realized, namely from low-end to high-end devices.

A large number of variants can also be created.

Extremely short delivery times result, namely on account of variants being formed during final assembly.

Functional subassemblies can lower costs.

The greater variability of the arrangement of the indicator and operator control means results in a greater degree of play in terms of design. New technologies can also be integrated in a simple manner.

In general, a greater scope of functions can be transferred from the panel 21 to the support 40, as compared to conventional devices. As a result, the panel itself can be produced in a simpler and thus more cost-effective manner. The panel can be produced with a largely continuous panel front in one mold. The openings for holding the various indicators and operator controls can be introduced subsequently (for example by punching, by water-jet cutting or the like).

Therefore, the panel 21 basically may assume only operator control and indicator functions. All other functional areas can be transferred to the support.

The operator controls and indicators 22 can be implemented with any desired technology, for example as standard keys or touch-control keys. The indicators may be light-emitting diodes, 7-segment displays, LCD modules, organic LED indicators or the like.

The lines 60, 70 from the indicators and operator controls 22 to the printed circuit board 60 generally comprise only signal lines.

However, it is also possible to provided a separate power line (as shown by 70*a*) in order to integrate an on/off function in the rotary knob 24.

The panel 21 can be produced with a reduced wall thickness. The area which is reduced as compared to the prior art thus results in considerably lower costs for the panel 21.

What is claimed is:

1. A panel arrangement for a domestic appliance, having a panel arranged to be fitted to the domestic appliance such that it is visible from an outside of the domestic appliance, at least one of indicators and at least one of operator controls, each of which are mounted on the panel, and having a printed circuit board, which comprises control electronics, arranged in the interior of the domestic appliance, with the at least one of indicators and the at least one of operator controls being connected to the printed circuit board, wherein at least one of the at least one of indicators and the at least one of operator controls operator controls, each of which are mounted on the panel independent of the layout of the printed circuit board and are connected to the printed circuit board via a flexible supply line, wherein the printed circuit board is mounted on an integrally formed support which is provided separately from the panel and wherein the printed circuit board is arranged in the interior of the domestic appliance between the panel and the integrally formed support, wherein the panel is attached to the integrally formed support, wherein the integrally formed support has a length extending over an entire width of the domestic appliance, wherein the integrally formed support comprises a container holding section adjacent to a retaining section for mounting the printed circuit board laterally adjacent to the container holding section for holding a functional container, comprising at least one of a drawer and a collection container, for containing materials during the function of the domestic appliance, wherein the container holding section has a frame section formed as part of the integrally formed support through which the functional container can be pushed from the outside.

2. The panel arrangement as claimed in claim 1, wherein the panel is formed in the manner of a box with a front and a circumferential rim section.

3. The domestic appliance as claimed in claim 1, wherein the mounting of the printed circuit board separately from the panel and the mounting of the at least one of the at least one of indicators and the at least one of operator controls independent of the layout of the printed circuit board provides a control panel arrangement which may be employed in a large number of different types of domestic appliances without necessitating any changes in the arrangement of the printed circuit board.

4. The panel arrangement as claimed in claim 1, wherein the at least one of the at least one of indicators and the at least one of operator controls operator controls are in each case individually connected to the printed circuit board.

5. The panel arrangement as claimed in claim 4, wherein the flexible supply line of at least one of the at least one of individually connected indicators and the at least one of individually connected operator controls are combined to form a cable harness.

6. A domestic appliance having:

a panel arrangement with a panel arranged to be fined to the domestic appliance such that it is visible from an outside of the domestic appliance, at least one of indicators and at least one of operator controls, each of which are mounted on the panel, and having a printed circuit board which comprises control electronics arranged in an interior of the domestic appliance, with the at least one of indicators and the at least one of operator controls being connected to the printed circuit board, wherein at least one of the at least one of indicators and the at least one of operator controls, each of which are mounted on the panel independent of the layout of the printed circuit board and are connected to the printed circuit board via a flexible supply line, wherein the printed circuit board is mounted on an integrally formed support which is separate from the panel and the printed circuit board is arranged in the interior of the domestic appliance between the panel and the integrally formed support, wherein the panel is fixed to the integrally formed support over the printed circuit board, wherein the integrally formed support extends over an entire width of the domestic appliance and provides structural support for opposed side walls of the domestic appliance, wherein the integrally formed support comprises an integral container holding section adjacent to a retaining section for mounting the printed circuit board laterally adjacent to the integral container holding section for holding a functional container, including at least one of a drawer and a collection container, for containing materials during the function of the domestic appliance, wherein the container holding section has a frame section formed as part of the integrally formed support through which the functional container can be pushed from the outside.

7. The domestic appliance as claimed in claim 6, wherein the mounting of the printed circuit board separately from the panel and the mounting of the at least one of the at least one of indicators and the at least one of operator controls independent of the layout of the printed circuit board provides a control panel arrangement which may be employed in a large number of different types of domestic appliances without necessitating any changes in the arrangement of the printed circuit board.

8. The domestic appliance as claimed in claim 6, wherein the support is secured to a section of a front wall of the domestic appliance.

9. The domestic appliance as claimed in claim 8, wherein the support is suspended on the front wall section by means of hooks.

* * * * *

UNITED STATES PATENT AND TRADEMARK OFFICE

CERTIFICATE OF CORRECTION

PATENT NO. : 7,700,900 B2
APPLICATION NO. : 11/384028
DATED : April 20, 2010
INVENTOR(S) : Geiger et al.

It is certified that error appears in the above-identified patent and that said Letters Patent is hereby corrected as shown below:

In Column 9, Line 59, In Claim 1, after "wherein" delete "at least one of".

In Column 9, Line 60, In Claim 1, after "one of" delete "operator controls".

In Column 10, Line 21, In Claim 3, after "mounting of the" delete "at least one of".

In Column 10, Line 29, In Claim 4, after "wherein the" delete "at least one of".

In Column 10, Line 30, In Claim 4, after "one of" delete "operator controls".

In Column 10, Line 33, In Claim 5, after "supply line of" delete "at least one of".

In Column 10, Line 38, In Claim 6, change "fined" to --fitted--.

In Column 10, Line 47, In Claim 6, after "board, wherein" delete "at least one of".

In Column 11, Line 7, In Claim 7, after "mounting of the" delete "at least one of".

Signed and Sealed this

Thirtieth Day of November, 2010

David J. Kappos

David J. Kappos
*Director of the United States Patent and Trademark Office*